United States Patent [19]

Lutzke et al.

[11] 4,331,430

[45] May 25, 1982

[54] TRIM MECHANISM WITH AUTOMATIC RETURN

[75] Inventors: Albert J. Lutzke, Oshkosh; James M. Schiek, Omro, both of Wis.

[73] Assignee: Brunswick Corporation, Skokie, Ill.

[21] Appl. No.: 159,999

[22] Filed: Jun. 16, 1980

[51] Int. Cl.[3] ..... B63H 1/14; B63H 5/06

[52] U.S. Cl. ..... 440/53; 440/55

[58] Field of Search ..... 440/53, 55, 56, 65, 440/63; 248/640, 641, 642, 643; 74/569

[56] References Cited

U.S. PATENT DOCUMENTS

| | | | |
|---|---|---|---|
| 2,583,910 | 1/1952 | Watkins | 248/642 |
| 2,684,044 | 7/1954 | Kiekhaefer | 248/642 X |
| 3,158,346 | 11/1964 | Jagger | 440/56 X |
| 3,371,893 | 3/1968 | Blanchard | 440/63 X |

*Primary Examiner*—Trygve M. Blix
*Assistant Examiner*—Harry A. Smith

[57] ABSTRACT

A tilt mechanism (10) for a marine propulsion device has a swivel bracket (13) pivotally attached to a transom bracket (11). A trim pin (21) is carried by a trim pin carrier (27) which is pivotally attached to the swivel bracket (13). The trim pin (21) travels in cam tracks (20) on the transom bracket (11) and engages notches (22, 23, 24) in the cam tracks (20) to establish trim and tilt positions for the propulsion device. An axial step (36) in the cam track (20) shifts the trim pin (21) to a return cam surface (25) to allow automatic return from the uppermost to the lowest position.

12 Claims, 6 Drawing Figures

TRIM MECHANISM WITH AUTOMATIC RETURN

DESCRIPTION

1. Technical Field

This invention relates to outboard motors and particularly to the supporting bracket therefor.

2. Background Art

U.S. Pat. No. 2,684,044 to Kiekhaefer describes a trim mechanism for outboard motors having a ratchet-like arrangement to automatically and releasably provide different trim positions for the propulsion unit. This arrangement allows the propulsion unit to be trimmed from its lower to upper position by merely tilting the propulsion unit. To return the unit to the lower position, however, requires manipulation of both the propulsion unit and a lever.

U.S. Pat. No. 3,371,893 to Blanchard describes a mechanism for supporting an outboard propulsion unit in two elevated positions and returning it to a lower position by manipulation of the propulsion unit. To achieve the intermediate support position requires the operator to tilt the unit up past the intermediate position and tilt it back down in an attempt to engage the intermediate support. Tilting the unit past the upper position requires a stutter step of tilting the unit to its upward limit, allowing it to drop down, and tilting it upward again before it can be tilted to its lowest position.

DISCLOSURE OF INVENTION

A tilt mechanism for a marine propulsion device has a swivel bracket for pivotally supporting a drive unit for steering. The swivel bracket is pivotally attached to a transom bracket to allow tilting movement of the swivel bracket. The transom bracket includes a closed circuit cam track including a plurality of notches and a return cam surface. A pawl assembly has one end pivotally attached to the swivel bracket and another end engaged with the cam track. The pawl assembly acts as a ratchet with the notches to provide a series of trim positions for the swivel bracket. The pawl assembly further acts as a cam follower with the return cam surface to allow the automatic return of the propulsion unit from its uppermost position to the lowest position.

In one embodiment the pawl assembly has a trim pin carried by a trim pin carrier pivoted to the swivel bracket. The trim pin is biased by a cam spring to engage a step between the notches and the return cam surface to shift the trim pin from following the notches to follow the return cam surface.

In another aspect of the invention a first series of the notches are positioned to allow the swivel bracket to rest against the trim pin when the trim pin is engaged with any one of those notches. At least one other notch is positioned to allow the trim pin carrier to support the swivel bracket in an elevated position.

A reverse lock assembly may be used to prevent upward tilting of the swivel bracket when the trim pin is engaged with any notch of the first series of notches or the shallow water drive notch and the drive is in reverse.

The invention provides a convenient way to adjust the trim position of a marine propulsion unit by simple manipulation of the propulsion unit.

BEST MODE FOR CARRYING OUT THE INVENTION

Figure 1:
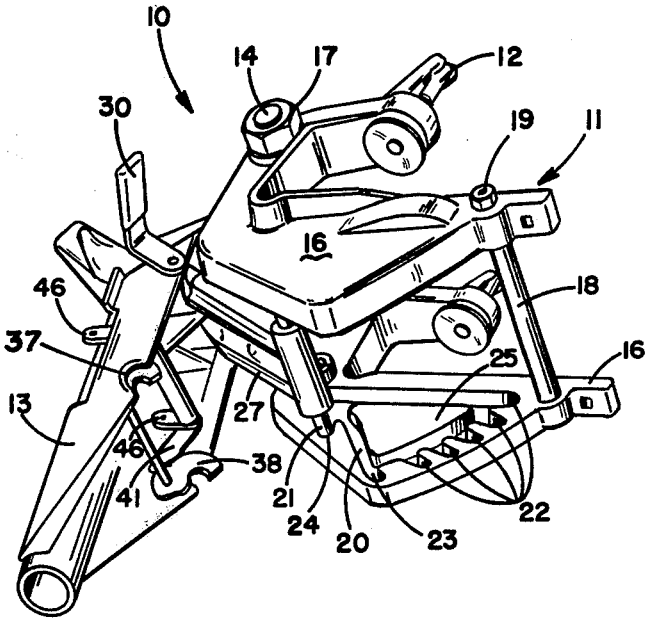
FIG. 1 is a perspective view of a transom and swivel bracket assembly incorporating various features of the invention.

The tilt mechanism 10 shown in the figures includes a transom bracket 11 having screw clamps 12 for attachment to the transom of a boat. A swivel bracket 13 is mounted on the transom bracket 11 by a pivot tube 14 for tilting movement about a horizontal tilt axis. The outboard drive unit, not illustrated, is then mounted on the swivel bracket 13 in a conventional manner to provide steering about a generally vertical steering axis 15.

The transom bracket 11 includes spaced right and left clamping members 16 attached to the swivel bracket 13 by the pivot tube 14 and end nuts 17. A tubular cross-member 18 and through bolt 19 fixes the spacing between the right and left members 16. The clamping members 16 have a matching set of closed circuit cam tracks 20 which receive the ends of the trim pin 21. The cam tracks 20 are formed by recessed channels having a series of five trim position notches 22, one shallow water drive notch 23 and one full tilt notch 24. The cam tracks 20 also include return cam surfaces 25 in the cam groove 20 to complete the circuit.

A pawl assembly includes a trim pin 21 and a trim pin carrier 27. The trim pin carrier 27 is pivotally attached to the swivel bracket 13 by a lever rod 28 journalled in bores in the swivel bracket 13. A lever 30 is attached to one end of the lever rod 28 and the trim pin carrier 27 is fixed to the lever rod 28 with a pin 31 to permit manipulation of the trim pin carrier 27 by the upward extending lever 30. The trim pin carrier 27 is biased in the stern direction, toward the swivel bracket 13, by a torsion pawl spring 32. The pawl spring 32 is supported on the lever rod 28 with its center portion 33 abutting against the center flange 34 of the swivel bracket 13. The two ends of the pawl spring 32 are hooked to the two arms of the trim pin carrier 27.

The trim pin 21 is mounted in holes 33 through the lower end of the trim pin carrier 27. The ends of the trim pin 21 are engaged in the recessed cam track channels 20 in the clamping members 16. A coil cam spring 34 abutting against one arm of the trim pin carrier 27 and a collar 35 on the trim pin 21 axially biases the trim pin 21 toward the starboard clamping member 16. As most clearly seen in FIGS. 4 and 5, a step 36 is provided in the starboard clamping member 16 at the bottom of the cam track groove 20, between the return cam surface 25 and the full tilt notch 24. The axially biased trim pin 21 rides against the bottom of the starboard cam track groove 20, and when it passes the step 36, is shifted axially to ride on the return cam surface 25.

The swivel bracket 13 includes two notched abutments 37, one on each side, which rest against the trim pin 21 when the trim pin is engaged with any of the trim position notches 22 or the shallow water drive notch 23.

Figure 2:
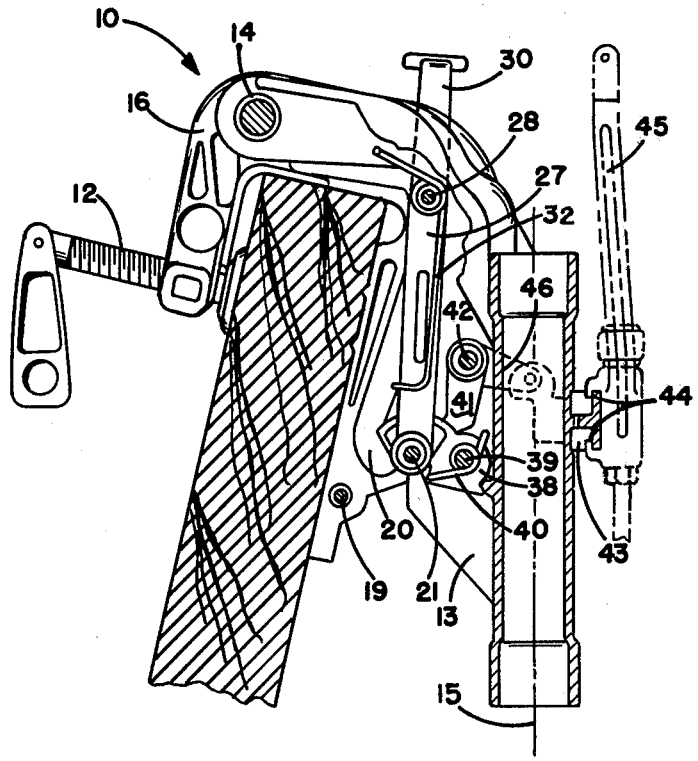
FIG. 2 is a side-elevational view of the transom and swivel bracket assembly of FIG. 1.
Figure 4:
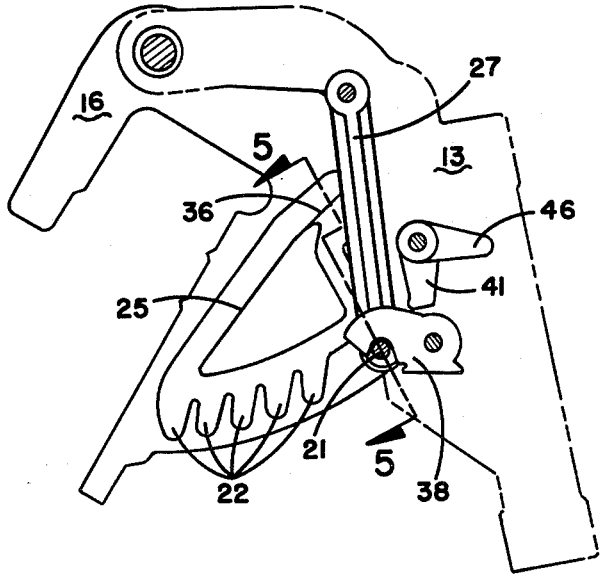
FIG. 4 is a schematic view of the assembly of FIG. 2.
Figure 5:
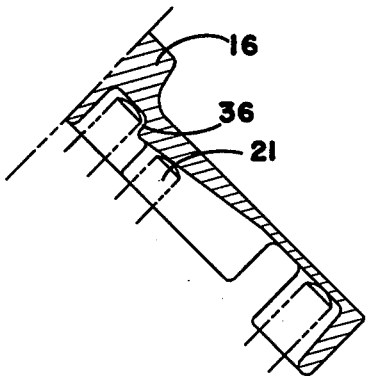
FIG. 5 is a sectional view taken along line 5—5 of FIG. 4.
Figure 6:
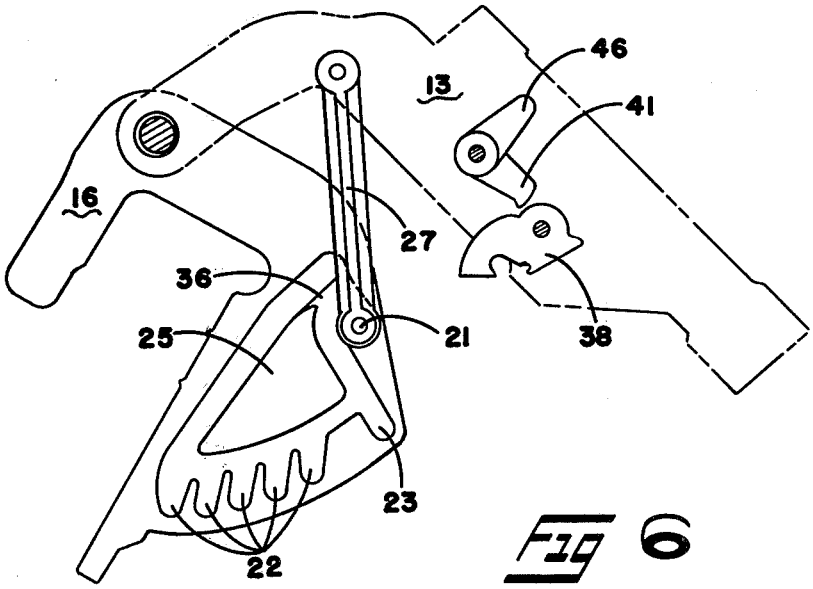
FIG. 6 is a schematic view of the assembly of FIG. 2 showing an upper tilt position.

Thus, in the trim position, as shown in FIGS. 2 and 4, thrust loads are carried by the trim notch 22, trim pin 21, and swivel bracket abutments 37. The upper tilt position notch 24 is closer to the tilt axis than are the trim notches 22. As a result, when the trim pin 21 is in the upper tilt notch 24, as shown in FIG. 6, the trim pin 21 and trim pin carrier 27 supports the swivel bracket 13 and drive unit in the elevated position.

Figure 3:
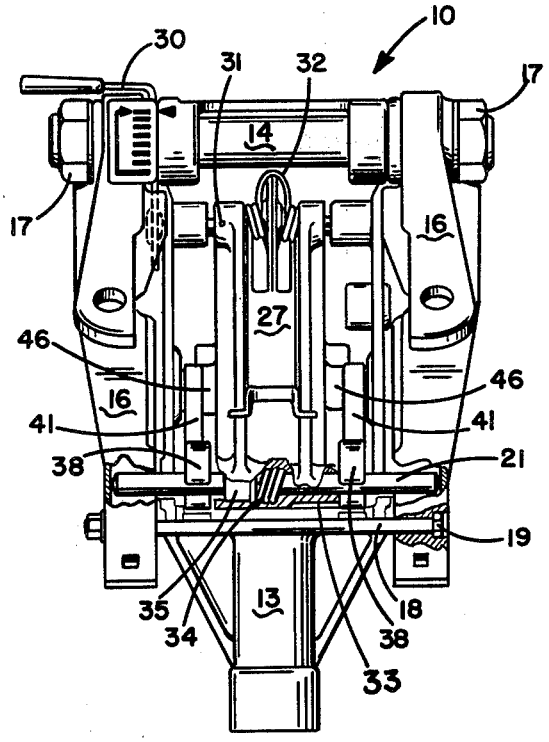
FIG. 3 is a front view of the assembly of FIG. 2.

The swivel bracket assembly also includes a pair of reverse hooks 38 which are pivoted to the swivel bracket 13 by a pin 39. The hooks 38 are loaded in a downward direction by torsion springs 40 mounted on the pin 39 and loaded between the reverse hook 38 and the swivel bracket 13. As shown in FIGS. 2, 3, and 4, the reverse hook 38 engages the trim pin 21 when the trim pin is positioned in one of the trim notches 22 or the shallow water drive notch 23.

Locking cams 41 are mounted above the reverse hooks 38 on the swivel bracket 13 by a pin 42. A shift rod follower 43 is supported by two lugs 44 on the shift rod 45, which moves parallel to the drive shaft to shift the transmission in the lower gear case between forward, neutral, and reverse. The shift rod follower 43 engages the lever 46 on the locking cam 41 to rotate the cam and lock the reverse hook 38 in place when the drive is shifted to reverse. Thus tilting of the drive unit is prevented when the drive is in a trim position and shifted to reverse.

Operation

The invention provides a simple way to adjust the trim or tilt position of an outboard drive unit by merely tilting the unit. Starting with the unit positioned a shown in FIG. 2, if the gear shift rod follower 43 is in the forward or neutral position, the reverse hooks 38 will be unlocked and the unit may be tilted upward to the desired trim angle. The pawl assembly will act as a ratchet with the notches 22 or 23, release the drive unit allowing the trim pin 21 to drop into one set of the trim notches in each of the clamping members 16, and the swivel bracket 13 will come to rest against the trim pin 21. With the drive unit in one of the trim positions the torsion spring 40 on the reverse hook 38 provides the required restraint to over come trailout (upward tilting of the drive unit) when decelerating in forward gear or when shifting from forward to neutral causing a loss of forward thrust. Shifting to reverse will lock the reverse hook 38 in place.

Raising the drive unit to the upper tilt position shown in FIG. 6 requires only that the unit be tilted to the appropriate angle and released. In the upper position the drive unit and swivel bracket 13 will come to rest on the trim pin carrier 27 and trim pin 21. In this position the notched abutments 37 in the swivel bracket 13 will not rest on the trim pin 21 and shifting to reverse will not lock the tilt position, since the reverse hook 38 will not be engaged with the trim pin 21.

To lower the drive unit from the upper positions the unit may be tilted upward until the trim pin end passes over the step 36 in the starboard clamp member 16. Then lowering the unit will allow the trim pin 21 to follow the return cam surface 25 until the drive unit reaches its lowest position.

Alternately, should the operator desire to lower the unit without going to the uppermost tilt position, the lever 30 may be pushed downward while the unit is tipped slightly upward to disengage the trim pin 21 from its corresponding notches. The drive unit may then be lowered to the desired trim angle and the lever released to engage the trim pin 21 in the desired notches.

We claim:

1. A tilt mechanism for a marine propulsion device comprising:

(A) a transom bracket for attachment to a boat, said transom bracket having a closed circuit cam track including a plurality of notches circumferentially spaced about a first generally horizontal axis and a return cam surface;

(B) a swivel bracket pivotally connected to said transom bracket for pivotal movement about said first horizontal axis;

(C) a pawl assembly having one end pivotally attached to said swivel bracket for rotation about a second generally horizontal axis, said pawl assembly having a second end and a biasing means for biasing said second end to engage said cam track and said notches, said pawl assembly acting as a ratchet with said series of notches to provide a series of trim positions for said propulsion device, and further acting as a cam follower with said return cam surface to allow the automatic return of said swivel bracket from the uppermost trim position to the lowest trim position.

2. A tilt mechanism for a marine propulsion device comprising:

(A) a transom bracket for attachment to a boat, said transom bracket having a closed circuit cam track including a plurality of notches circumferentially spaced about a first generally horizontal axis and a return cam surface, said closed circuit cam track lying in a plane generally perpendicular to said first and second axes and including a step between said notches and said return cam surface;

(B) a swivel bracket pivotally connected to said transom bracket for pivotal movement about said first horizontal axis;

(C) a pawl assembly having one end pivotally attached to said swivel bracket for rotation about a second generally horizontal axis, said pawl assembly having a second end and a biasing means for biasing said second end to engage said cam track and said notches, said pawl assembly acting as a ratchet with said series of notches to provide a series of trim positions for said propulsion device, and further acting as a cam follower with said return cam surface to allow the automatic return of said swivel bracket from the uppermost trim position to the lowest trim position.

3. The tilt mechanism defined in claim 2 wherein said pawl assembly comprises a trim pin carrier having a first end pivotally attached to said swivel bracket and a trim pin attached to a second end of said trim pin carrier, said trim pin having an end extending generally parallel to said first and second axes to engage said cam track.

4. The tilt mechanism defined in claim 3 wherein said biasing means comprises a cam spring to axially bias said trim pin end toward said step.

5. The tilt mechanism defined in claim 4 wherein said biasing means comprises a pawl spring to bias said trim pin carrier toward said swivel bracket and toward said notches.

6. The tilt mechanism defined in claim 5 wherein said notches comprise a first series of notches positioned to enable said swivel bracket to rest against said trim pin when said trim pin is engaged with one of said first series of notches.

7. The tilt mechanism defined in claim 6 wherein said plurality of notches comprise at least a one other notch positioned to enable said trim pin carrier to support said swivel bracket when said trim pin is engaged with said one other notch.

8. The tilt mechanism defined in claim 7 further comprising a reverse lock assembly to prevent said swivel bracket from rotating relative to said transom bracket when reverse thrust is applied to said swivel bracket and said trim pin is engaged with one of said first series of notches.

9. The tilt mechanism defined in claim 8 wherein said reverse lock assembly comprises a hook pivotally attached to said swivel bracket and positioned to engage said trim pin when said trim pin is engaged with said first series of notches.

10. The tilt mechanism defined in claim 9 wherein said reverse lock assembly further comprises a locking cam to lock said hook in position relative to said swivel bracket.

11. The tilt mechanism defined in claim 9 wherein said reverse lock assembly further comprises a spring to bias said hook to engage said trim pin when said trim pin is engaged with said first series of notches.

12. The tilt mechanism defined in claim 3 further comprising a lever attached to said trim pin carrier to permit manual disengagement of said trim pin from said notches for selective positioning of said drive unit.

* * * * *